US007269363B2

(12) United States Patent
Murata

(10) Patent No.: US 7,269,363 B2
(45) Date of Patent: Sep. 11, 2007

(54) DEVELOPING APPARATUS, DEVELOPING METHOD, AND DEVELOPING AGENT THEREFOR

(75) Inventor: Hiroshi Murata, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 373 days.

(21) Appl. No.: 10/940,624

(22) Filed: Sep. 15, 2004

(65) Prior Publication Data

US 2006/0056863 A1 Mar. 16, 2006

(51) Int. Cl.
*G03G 15/08* (2006.01)

(52) U.S. Cl. ..... 399/27; 399/267; 430/120

(58) Field of Classification Search ..... 430/111.4, 430/120; 399/27, 267
See application file for complete search history.

(56) References Cited

U.S. PATENT DOCUMENTS 5,819,132 A * 10/1998 Hirobe ..... 399/49
5,870,656 A * 2/1999 Hibino et al. ..... 399/149
6,096,466 A * 8/2000 Imai et al. ..... 430/111.4

FOREIGN PATENT DOCUMENTS

JP 3352569 B2 9/2002
JP 3379318 B2 12/2002

* cited by examiner

*Primary Examiner*—John L Goodrow
(74) *Attorney, Agent, or Firm*—Foley & Lardner LLP

(57) ABSTRACT

A developing apparatus is provided in which a replenishment developer when replenished has been electrified to a sufficient extent and can immediately produce an effect of replenishment, with a small consumption of a carrier. In an developing apparatus 100 of the present invention, by means of a first and a second agitation and conveyance screw 21, 22 arranged in an upper space 13 and a lower space 14, respectively, a first two-component developer LT stored in the spaces is agitated and conveyed, so that it is supplied to a developing roller 20 so as to perform development processing of an electrostatic latent image on a photosensitive member. This developing apparatus replenishes a second two-component developer HT stored in a cartridge 30 into a first two-component developer LT in the spaces in an appropriate manner in accordance with the progress of the development process, so that a component composition of the first two-component developer can be kept within a prescribed range. In this case, amounts of electrification Q1, Q2 of the first and second two-component developers are set to be Q2=Q1×A (A=0.6–1.5) when the second two-component developer is readjusted to the same state of its toner concentration as that of the first two-component developer.

9 Claims, 6 Drawing Sheets

FIG.8

| | AMOUNT OF ELECTRIFICATION Q1 OF INITIAL DEVELOPER LT | AMOUNT OF ELECTRIFICATION Q2 OF REPLENISHMENT DEVELOPER HT | VALUE OF a (Q2=a x Q1) | RESULTS | |
|---|---|---|---|---|---|
| SERIES 1 | 22 μc/g | 8 μc/g | 0.36 | × | TONER DISPERSION |
| | 22 μc/g | 10 μc/g | 0.45 | × | FOG (SMUDGE IN NONIMAGE AREA) |
| | 22 μc/g | 13 μc/g | 0.59 | ○ | |
| | 22 μc/g | 21 μc/g | 0.95 | ○ | |
| | 22 μc/g | 30 μc/g | 1.36 | ○ | |
| | 22 μc/g | 35 μc/g | 1.59 | × | REDUCTION IN IMAGE DENSITY |
| SERIES 2 | 37 μc/g | 15 μc/g | 0.41 | × | FOG |
| | 37 μc/g | 26 μc/g | 0.70 | ○ | |
| | 37 μc/g | 38 μc/g | 1.03 | ○ | |
| | 37 μc/g | 52 μc/g | 1.41 | ○ | |
| | 37 μc/g | 58 μc/g | 1.57 | △ | SLIGHT REDUCTION IN IMAGE DENSITY |
| | 37 μc/g | 61 μc/g | 1.65 | × | REDUCTION IN IMAGE DENSITY |

DEVELOPING APPARATUS, DEVELOPING METHOD, AND DEVELOPING AGENT THEREFOR

BACKGROUND OF THE INVENTION

1. Field of the Invention

The present invention relates to a developing apparatus, a developing method, and a developing agent or developer for such a developing apparatus, in which development is performed by using a first two-component developer of a first toner concentration and a second two-component developer of a second toner concentration that is higher than the first toner concentration.

2. Description of the Related Art

In a developing apparatus employed in an electrophotography machine such as a copying machine, a printer, a facsimile machine, etc., using a dry two-component developer (toner and carrier) as stated above, as development processing is repeated, a toner component is being consumed, whereas a carrier is being reduced in its electrification performance due to peeling off of a resin coating material on the surface of each carrier particle, adhesion of the toner component to the surfaces of toner particles, and so on. As the electrification performance is reduced, the quality of images that are developed by the developing apparatus is deteriorated. Thus, there has been proposed a technique in which a carrier is replenished together with a toner so as to decrease such reduction of the toner and the electrification performance, whereby the interior of the developing apparatus can be kept at a constant condition even if development processing is repeated. For example, in Japanese patent application laid-open No. S62-127874 (US (31) 801366) (FIGS. 2, 5, 6, 7, and page 9), a toner and a carrier are supplied together or separately from each other so as to keep constant the toner concentration that is changing in accordance with the progress of development processing. In such a case, for example in Japanese patent application laid-open No. H6-301289 (FIG. 1, page 7, and summary), a two-component developer is controlled to keep its bulk or volume constant.

However, in case where the toner and the carrier are simply replenished to the two-component developer as stated above, they are not electrified until after the replenishment thereof. As a result, sufficient electrification is not performed at appropriate timing, so it is difficult to satisfactorily produce an effect of replenishment. In this case, in particular, as the reduction in size of the developing apparatus progresses, the duration permitted for electrification in the developing apparatus is becoming shortened, thus lowering the effect of replenishment. In addition, even if the toner and the carrier have been beforehand mixed at the time of the replenishment thereof, electrification thereof is not carried out to a satisfactory extent, so the effect of replenishment is not satisfactorily exhibited.

Accordingly, consideration has been given to such a problem that electrification is not satisfactorily performed even when the toner and the carrier have been beforehand mixed with each other at the time of their replenishment. As shown in FIG. 10, in the past, a toner and a carrier, which together constitute a two-component developer, are provided in steps S11 and S12, respectively, and mixed with each other in step S13 as indicated by lines Y11, Y12, and then put into and stored in a developing apparatus as a two-component developer LT of a low toner concentration to be supplied to a developing roller in step S14 as indicated by line Y13. On the other hand, the toner and the carrier provided in steps S11, S12 are also put into and stored, as a replenishment two-component developer JT of a high toner concentration, in a cartridge detachably attached to the developing apparatus in step S15 as indicated by lines Y14, Y15.

The replenishment two-component developer JT prepared in the above-mentioned manner has a toner concentration higher than that of the two-component developer supplied to the developing roller (i.e., the amount of the carrier is smaller in comparison with the toner). As a consequence, it could be understood that even if the toner and the carrier were mixed with each other, there would be a small chance that particles of the toner are compressed between particles of the carrier, thus resulting in insufficient electrification. Accordingly, there was also another consideration that the amount of carrier to be mixed should be increased for the replenishment developer, but following such a consideration results in another problem that the consumption of the carrier increases to push up the cost and it becomes necessary to take a large discharge space for a degraded carrier.

SUMMARY OF THE INVENTION

The present invention is intended to obviate the problems as referred to above, and has for its object to provide a developing apparatus, a developing method and a developing agent or developer used therein in which a replenishment developer is in a sufficiently electrified state upon replenishment thereof so as to be able to immediately exert an effect of replenishment, thus making it possible to suppress the consumption of the carrier without the need to increase the amount of the carrier to be mixed into the replenishment developer.

In order to solve the above-mentioned problems, a developing apparatus according to one aspect of the present invention comprises: a first storage part that stores a first two-component developer which has a first toner concentration and an amount of electrification Q1; a second storage part that stores a second two-component developer which has a second toner concentration higher than that of the first two-component developer, and an amount of electrification Q2 when readjusted into the same toner concentration as that of the first two-component developer, where $Q2=Q1\times A$ ($A=0.6-1.5$); a development processing part that supplies the first two-component developer to a developing roller so as to develop an electrostatic latent image on a photosensitive member; and a development control part that controls a component composition of the first two-component developer so as to keep the component composition within a prescribed range by replenishing the second two-component developer into the first two-component developer in an appropriate manner in accordance with the progress of the development process of the development processing part.

In addition, the developing apparatus according to another aspect of the present invention comprises: a first outer casing that stores a first two-component developer which has a first toner concentration and an amount of electrification Q1; a cartridge that stores a second two-component developer which has a second toner concentration higher than that of the first two-component developer, and an amount of electrification Q2 when readjusted to the same toner concentration as that of the first two-component developer, where $Q2=Q1\times A$ ($A=0.6-1.5$), the cartridge being detachably attached to the outer casing; a development agitation and conveyance device that supplies the first two-component developer to a developing roller so as to develop an electrostatic latent image on a photosensitive member; and a development control part that controls a component composition of the first two-component developer so as to keep the component composition within a prescribed range by replenishing the second two-component developer into the first two-component developer in an appropriate manner in accordance with the progress of the development process of the development agitation and conveyance device.

Moreover, a developing method according to a further aspect of the present invention comprises: a step of storing a first two-component developer which has a first toner concentration and an amount of electrification Q1, and a second two-component developer which has a second toner concentration higher than that of the first two-component developer, and an amount of electrification Q2 when readjusted to the same toner concentration as that of the first two-component developer, where Q2=Q1×A (A=0.6–1.5); a step of supplying the first two-component developer to a developing roller so as to perform development processing of an electrostatic latent image on a photosensitive member; and a step of controlling a component composition of the first two-component developer so as to keep the component composition within a prescribed range by replenishing the second two-component developer into the first two-component developer in an appropriate manner in accordance with the progress of the development process.

Further, a developing agent for a developing apparatus according to a yet further aspect of the present invention is provided in which a first two-component developer of a first toner concentration stored in a first toner storage part of the developing apparatus, and a second two-component developer having a second toner concentration higher than that of the first toner concentration and an amount of electrification Q2 stored in a cartridge detachably attached to the first toner storage part are used as developers, wherein the amounts of electrification Q1, Q2 of the first and second two-component developers are set to be Q2=Q1×A (A=0.6–1.5) when the toner concentrations of the first and second two-component developers are readjusted to the same state.

According to the above constructions, when the second two-component developer is replenished to the first two-component developer, the carrier in the second two-component developer has already been sufficiently electrified, as a result of which the second two-component developer can produce the function similar to that of the first two-component developer. Accordingly, reduction in the amount of electrification of the first two-component developer becomes smaller even in case where a multitude of sheets of image formation are carried out by using the first two-component developer while the second two-component developer is being replenished to the first two-component developer. In addition, since the amount of the carrier in the second two-component developer is not increased, the consumption of the carrier does not increase.

BRIEF DESCRIPTION OF THE DRAWINGS

FIG. 8 is a view showing the check results of changes in quality of image formation when the amounts of electrification of replenishment developers are changed.

DESCRIPTION OF THE EMBODIMENTS

Figure 1:
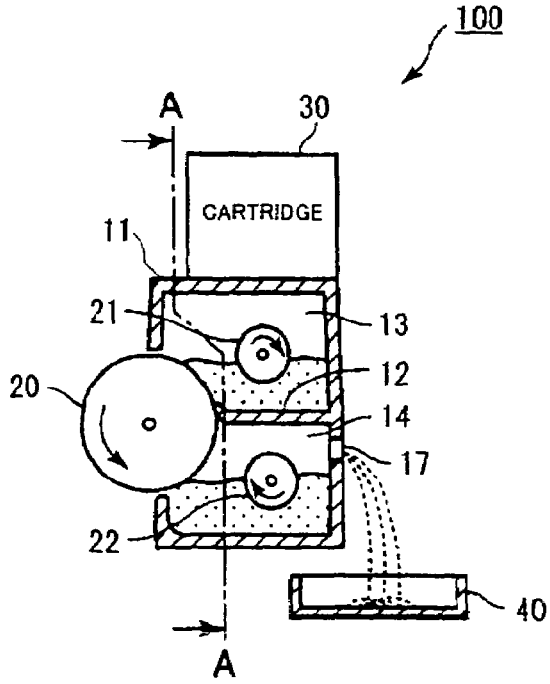
FIG. 1 is a cross sectional view showing a developing apparatus to which a developing method according to one embodiment of the present invention is applied.
Figure 2:
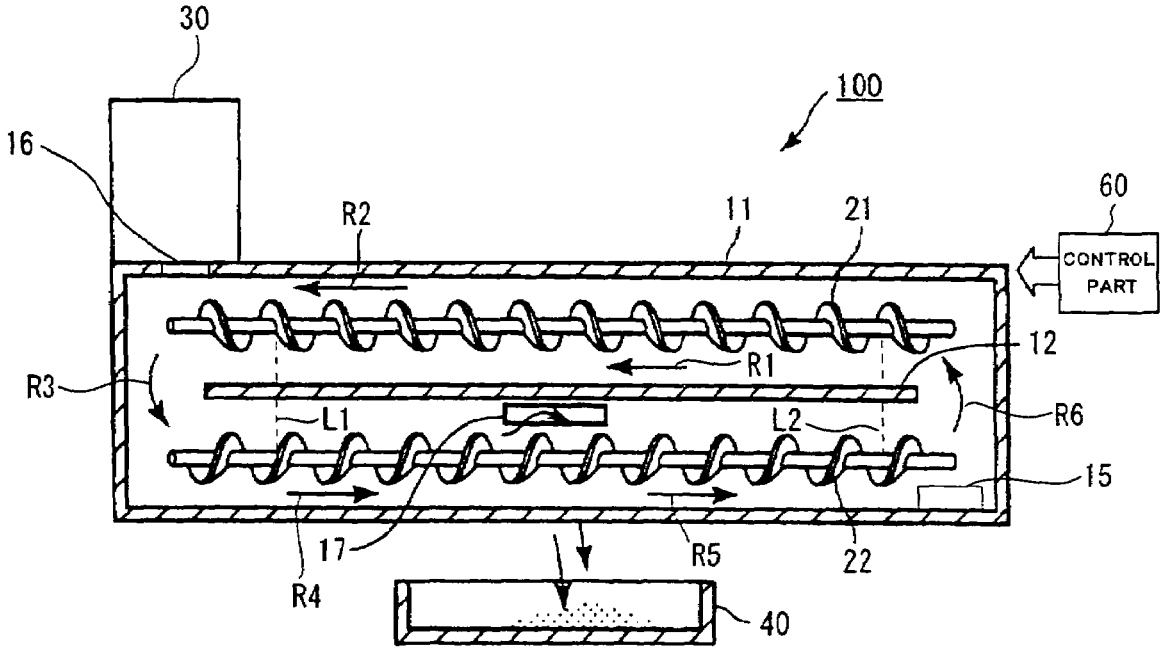
FIG. 2 is a cross sectional view as seen from line A-A in FIG. 1.
Figure 3:
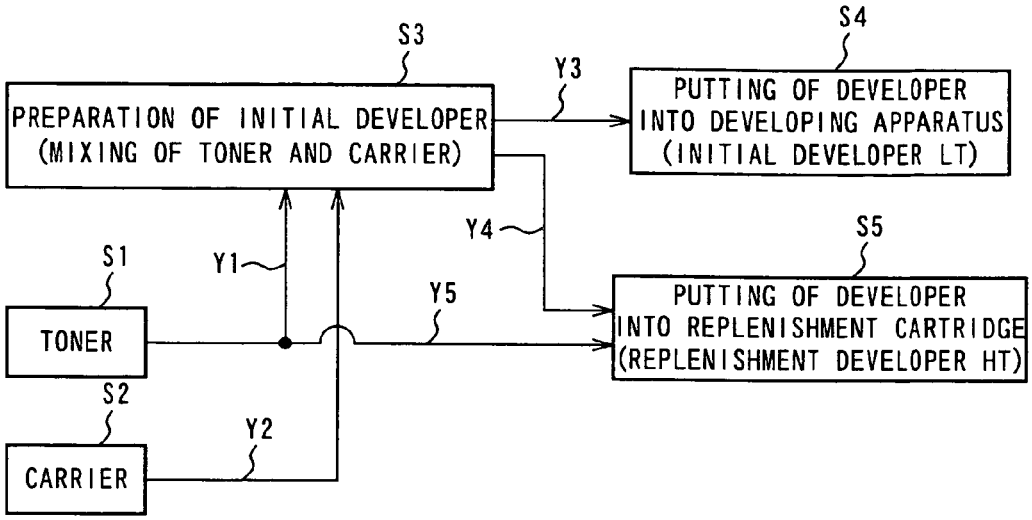
FIG. 3 is a flow chart illustrating a preparation procedure of a developing agent or developer used in the developing apparatus shown in FIG. 1.

Hereinafter, embodiments of the present invention will be described in detail while referring to the accompanying drawings. FIG. 1 is a cross sectional view that illustrates a developing apparatus to which a developing method according to a first embodiment of the present invention. FIG. 2 is a cross sectional view that is seen from line A-A in FIG. 1. FIG. 3 is a flow chart that illustrates a preparation procedure of a developing agent or developer used in the developing apparatus shown in FIG. 1. In a developing apparatus 100 of FIG. 1, an outer casing 11 has its interior divided by a partition plate 12 into an upper space 13 and a lower space 14. Here, note that the partition plate 12 has its opposite ends partially cut away so as to connect the upper space 13 and the lower space 14 with each other (see FIG. 2). A developing roller 20 with a built-in magnet is disposed in one side wall of the outer casing 11 that is arranged in opposition to a photosensitive drum (not shown) so as to extend horizontally (i.e., extend between lines L1, L2 in FIG. 2). In the upper space 13, there is arranged a first agitation and conveyance screw 21 for agitating and conveying a first two-component developing agent or developer of a first toner concentration in a manner to extend in parallel to the developing roller 20. In the lower space 14, there is also arranged a second agitation and conveyance screw 22 in a manner to extend in parallel to the developing roller 20.

A cartridge 30 for receiving or storing a replenishment second two-component developer of a second toner concentration is detachably attached to an upper surface of the outer casing 11. A replenishment opening 16 for replenishing the second two-component developer from the cartridge 30 into the upper space 13 is formed through the upper surface of the outer casing 11 at a location at which the cartridge 30 is mounted. In addition, a degraded developer discharge port 17 to overflow a surplus amount of the developer is arranged in a side wall of the lower space 14, and a degraded developer receiving part 40 for receiving the surplus developer discharged from the degraded developer discharge port 17 is arranged at a location thereunder. Further, a toner concentration sensor 15 (e.g., a magnetic permeability sensor) is arranged on the bottom portion of the lower space 14 for detecting the toner concentration of the developer therein. A control part 60 controls the cartridge 30 to properly replenish a developer HT from the cartridge 30 to a developer LT in the outer casing 11 so that the toner concentration detected by the toner concentration sensor 15 becomes within a prescribed range.

Although in this embodiment, the discharge position for the degraded developer is set or determined as mentioned above in the developing apparatus with the spaces arranged one over the other as shown in FIGS. 1, 2, such a degraded developer discharge position is not limited to the one illustrated in this embodiment.

In addition, in this example, in both of the upper space 13 and the lower space 14, the first two-component developer LT of a low toner concentration (e.g., a toner concentration of 8%) is received or stored as a developer to be supplied directly to the developing roller 20. Also, in the cartridge 30, the second two-component developer HT of a high toner concentration (e.g., a toner concentration of 90%) is received or stored as a replenishment developer. In this case, the carriers contained in the first and second two-component developers are electrified substantially to the same degree, as will be described later. The toners that constitute the two-component developers are composed of a binder resin and a coloring agent as their principal components. As the binder resin, there are exemplified polystyrene, styrene acrylic copolymer, polyester, epoxy resin, silicone resin, polyamide, paraffin wax, and so on, and as the coloring agent, there are exemplified carbon black, aniline blue, chrome yellow, ultramarine blue, pigment blue, pigment red, pigment yellow, and so on. In this case, the toners may contain an electrification control agent, a cleaning assistant, a mould release accelerator, a flowability accelerator, or the like, as required. As the carriers, there are employed particles of magnetic materials such as ferrite, iron oxide, etc., or magnetic particles of these materials coated with resin. As such a coating resin, there is used a fluorine based resin, an acrylic based resin, a silicon resin, or the like. Alternatively, there may also be used resins containing therein magnetic powder.

When the developing apparatus 100 as set in the above manner is started, the first agitation and conveyance screw 21 is driven to rotate, whereby the first two-component developer LT is conveyed in directions as indicated at arrows R1, R2. The developer LT is conveyed in the directions of arrows R1, R2 and supplied onto the developing roller 20 to form a so-called magnetic brush thereon. The toner contained in the developer LT is adhered to an electrostatic latent image on the photosensitive drum under the action of this magnetic brush, whereby development of the image is performed. Those portions of the toner and the carrier which are not used for development are collected into the lower space 14 as indicated at arrow R3. The developer LT collected in the lower space 14 is conveyed while being agitated, as indicated at arrows R4, R5, so as to be moved from the lower space 14 into the upper space 13, as indicated arrow at R6, and then supplied for development while being again conveyed in the directions indicated at arrows R1, R2 in the upper space 13.

Now, reference will be made to one example of a preparation method for the first two-component developer LT of a low toner concentration stored in the upper space 13 and the lower space 14 and the second two-component developer HT of a high toner concentration in the cartridge 30 as stated above while referring to FIG. 3. According to the preparation method for the developer LT, the toner and the carrier, which are provided in steps S1, S2, respectively, are supplied at an appropriate ratio (e.g., a ratio at which the toner concentration becomes 8%) in an ordinary manner, and agitated and mixed with each other by the use of a Henschel mixer or the like in step S3 to prepare the developer LT. In the preparation of the developer LT, the toner concentration of the developer LT is low and the amount of the carrier therein is large, so the amount of electrification of the developer LT becomes sufficient when agitated and mixed.

The developer LT thus prepared is put into the upper space 13 and the lower space 14 of the developing apparatus 100 as an initial developer LT, as indicated at arrow Y3 (step S4). On the other hand, a part of the developer LT prepared in step S3 is separated and taken out from the reminder thereof (arrow Y4), and the toner provided in step S1 is added to the thus prepared developer LT at a prescribed ratio, as indicated at arrow Y5, to make a developer HT in the form of a replenishment developer, which is then supplied to the cartridge 30. In this case, the carrier contained in the developer HT supplied to the cartridge 30 has been agitated and mixed in a state of a low toner concentration (i.e., a state of the carrier being abundant in the toner). Therefore, the carrier has been electrified or charged to a satisfactory extent (to be described later with reference to FIG. 5), and hence is able to be work in a stable manner immediately when replenished to the developer LT in the upper space 13 of the developing apparatus 100, as in the case of the other carrier already stored therein.

Figure 4:
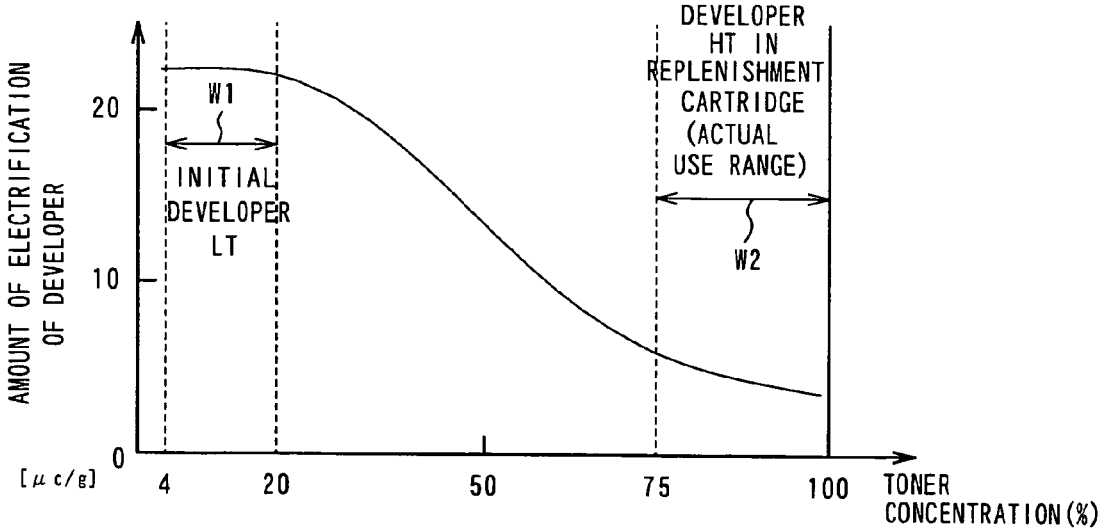
FIG. 4 is a graphic representation explaining the amount of electrification of a developer that is changed by adding a toner to a developer.

Though the replenishment developer HT is prepared in this manner by adding the toner to the developer LT, in that case, the toner concentration and the amount of electrification per gram (μc/g; being measured for example by a blow-off electrification amount measuring device, etc.) are changed depending on the amount of the toner to be added. FIG. 4 illustrates this change. That is, though the developer LT is prepared in such a manner that the toner concentration becomes within a range W1 at the beginning, the amount of electrification (μc/g) is gradually decreasing to about a lower range W2 as the toner added thereto is successively increased. Thus, the developer HT with the amount of electrification being within the range W2 or therearound is put into the cartridge 30.

The developer LT of a toner concentration of 8% prepared as described above, the replenishment developer JT of a toner concentration of 90% prepared according to the prior art method, and the replenishment developer HT of a toner concentration of 90% prepared as described above are provided, and the toner components in the developer JT and the developer HT are decreased to 8%, thus preparing a developer JTd and a developer HTd, respectively. A comparison is made between the amounts of electrification per gram (μc/g) of the developers LT, JTd and HTd, and the result of comparison is graphically represented in FIG. 5.

Figure 5:
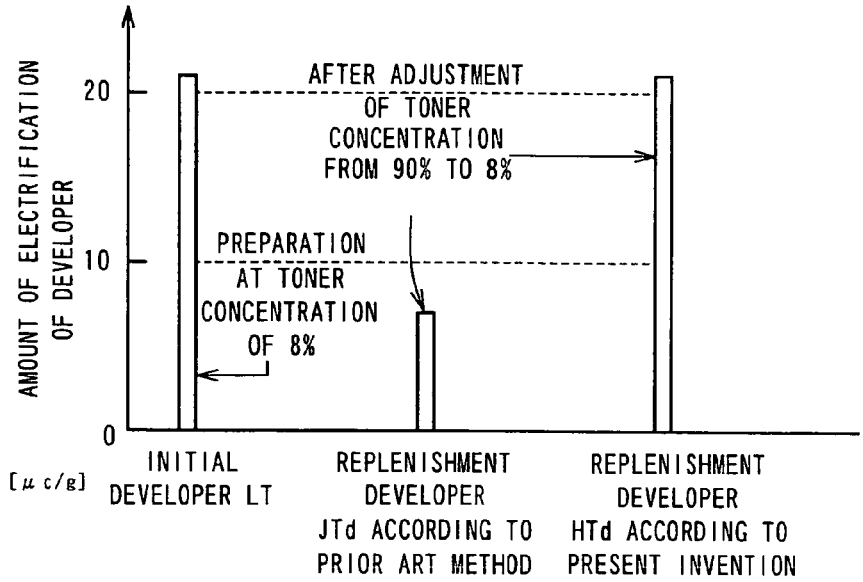
FIG. 5 is a graphical representation that relates to a replenishment developer prepared according to a prior art method and another replenishment developer as an inventive example prepared by using an initial developer according to the method of the present invention, while explaining a comparison between the amounts of electrification of both the developers when the toner concentrations thereof are lowered to that of the initial developer.

As can be seen from FIG. 5, it is found that the developer JTd prepared by mixing a carrier with a large amount of toner as according to the prior art method has a low amount of electrification in the state of its toner concentration being decreased to 8%, but the developer HTd even with its toner concentration being decreased to 8% has a high amount of electrification substantially equal to that of the developer LT. From this, it can be understood that in the two-component developer having been beforehand agitated and mixed at a low toner concentration, a sufficient amount of electrostatic force is generated so that the toner and the carrier therein are excellently attracted to each other under the action of the electrostatic force, as a result of which the amount of electrification already acquired is not lost even if a small amount of the two-component developer is added to the large amount of the toner. Accordingly, it can be understood that as stated above, the carrier contained in the replenishment developer HT becomes able to work in a stable manner at once when the replenishment developer HT is replenished to the developer LT in the upper space 13, similar to the other carrier already existing therein.

Figure 10:
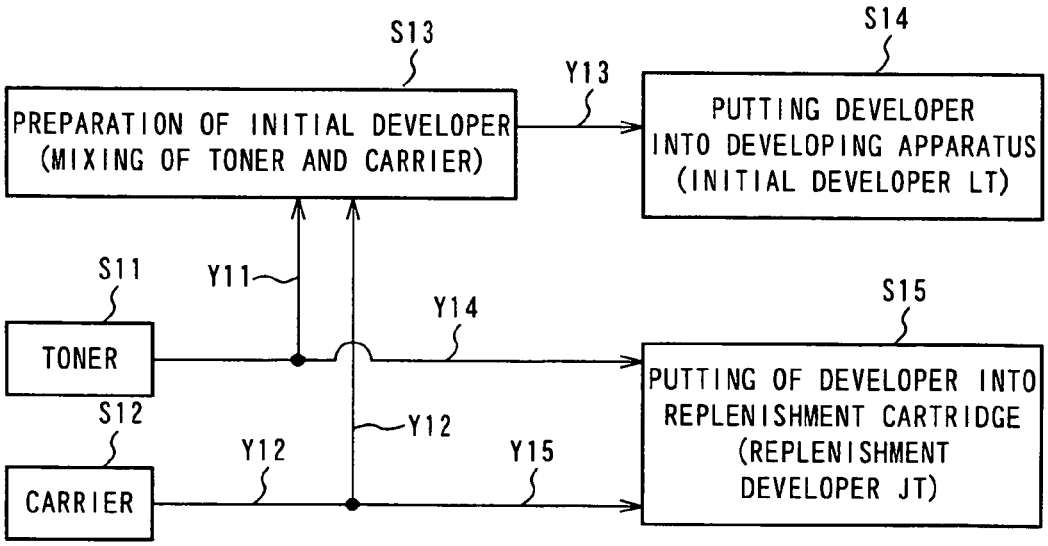
FIG. 10 is a flowchart showing a preparation procedure of conventional developers.

Subsequently, an image of a print rate of 6% was printed up to a number of output sheets of 200,000 as a test using an image forming apparatus that was provided with the above-mentioned developing apparatus 100. In this case, as a setting for the embodiment according to the present invention, the developer LT of a toner concentration of 8% was stored in the upper space 13 and the lower space 14 of the developing apparatus 100, and the replenishment developer HT of a toner concentration of 90% was stored in the cartridge 30, whereas as a setting for the comparison example according to the prior art, the developer LT of a toner concentration of 8% was stored in the upper space 13 and the lower space 14 of the developing apparatus 100, and the replenishment developer JT of a toner concentration of 90% prepared according to the process steps as illustrated in FIG. 10 was stored in the cartridge 30.

Figure 6:
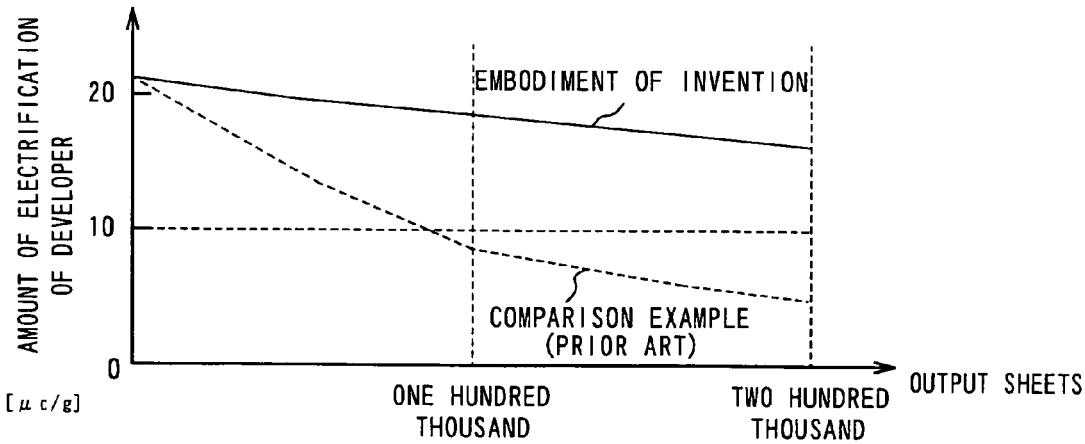
FIG. 6 is a graph showing changes in the amounts of electrification of developers stored in an upper space and a lower space in case where a multitude of prints were carried out by using a replenishment developer prepared according to the embodiment of the present invention and a replenishment developer prepared according to the comparison example, respectively.

FIG. 6 shows the amounts of electrification of the developers LT stored in the upper space 13 and the lower space 14 measured for the embodiment of the present invention and the comparison example, respectively, in accordance with the progress of the above-mentioned test or examination. As will be clear from FIG. 6, the amount of electrification is substantially steady or constant in the embodiment of the present invention in comparison with the case of the comparison example in which the amount of electrification of the developer LT received in the upper space 13 and the lower space 14 is decreasing to a much greater extent. In addition, though not shown in the graph, when the amount of electrification decreases to 10 μc/g or below (see the comparison example), toner dispersion from the developing apparatus became liable to occur, and smudge or soil (fog) in nonimage areas came to appear, too, so it can be understood from this fact that as the number of sheets being printed increases, the embodiment of the present invention becomes more advantageous than the comparison example.

Further, the developer LT is stored in the upper space 13 and the lower space 14, and the replenishment developer HT according to the embodiment of the present invention or the replenishment developer JT of the comparison example according to the prior art was stored in the cartridge 30, and a multitude of copies for images of print rates of 6%, 12% and 30%, respectively, were printed while changing the toner concentrations of the replenishment developers HT, JT. In that case, the amount of electrification of the developer LT stored in the upper space 13 and the lower space 14 was measured when the number of output sheets reached one hundred thousand sheets, and the result is illustrated in a graph of FIG. 7.

Figure 7:
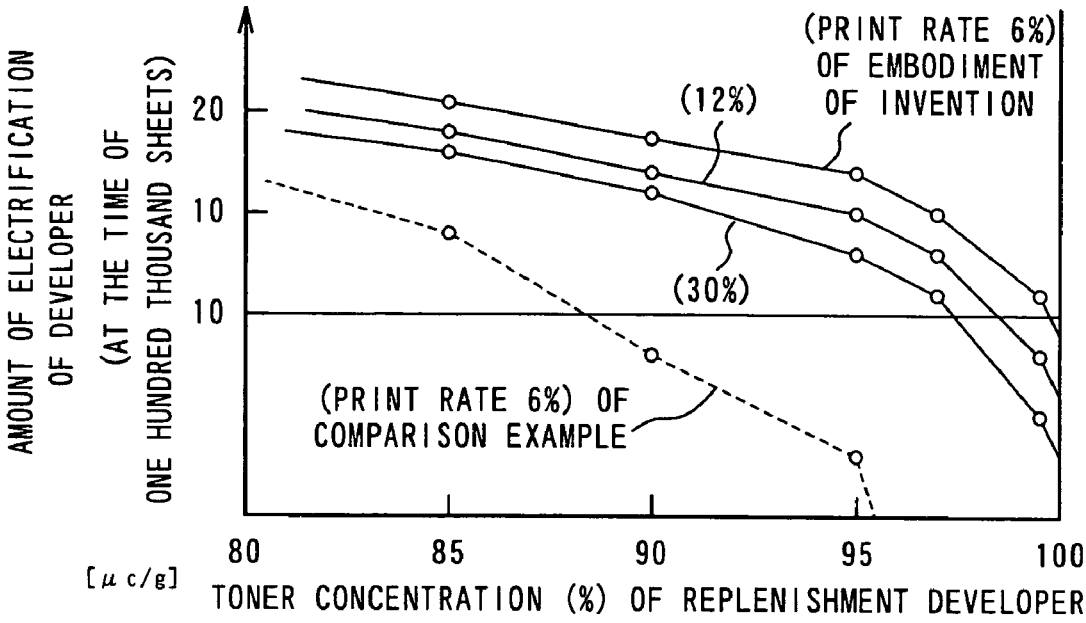
FIG. 7 is a graph showing the results of measuring the amounts of electrification of the developers stored in the upper space and the lower space when the number of output sheets reached one hundred thousand sheets in case where a multitude of prints are carried out for images of print rates of 6%, 12% and 30%, respectively, while changing the toner concentrations of the replenishment developers prepared according to the embodiment of the present invention and of the replenishment developers prepared according to the prior art.

As is clear from FIG. 7, in both of the embodiment of the present invention and the comparison example, there is a tendency that the amount of electrification of the developer LT decreases as the toner concentration of the replenishment developer HT or JT is raised, that is, the amount of the carrier contained therein is decreased. As stated above, it is desirable that the amount of electrification be greater than 10 μc/g, and this value is obtained satisfactorily in the embodiment of the present invention but not in the example. In the embodiment of the invention, reduction in the amount of electrification can be suppressed even when the toner concentration of the replenishment developer is high, that is, when the amount of the carrier is small. Thus, it is found that even in case of a high print rate (30%), the embodiment of the invention is more advantageous than the comparison example. In addition, in the embodiment of the invention, there is also a tendency that the lower the toner concentration of the replenishment developer HT (i.e., the greater the amount of the carrier), the less prone to reduce the amount of electrification becomes. If, however, the amount of the carrier used is increased, the running cost goes up and the amount of the developer discharged increases, too, so the amount of carrier to be used should be appropriate.

Next, consideration was given to in what range the amount of electrification of the replenishment developer HT should be, according to the present invention. In the above-mentioned cases, in order for the tests to be performed easily, the toner was added to the developer LT initially prepared to make the replenishment developer HT. Accordingly, in case where the toner component in the replenishment developer HT thus prepared was decreased to the same low level as that of the developer LT, the amount of electrification per gram of the replenishment developer was substantially at the same level as in the case of the developer LT (see FIG. 3). Therefore, here, in order to examine in what range the amount of electrification per gram of the replenishment developer HT should be, a plurality of replenishment developers HT were prepared which had different amounts of electrification Q1 when the toner component in each replenishment developer HT once prepared was decreased to provide the same toner concentration as that of the developer LT. Image formations were carried out by using the plurality of replenishment developers HT thus prepared, and the qualities of the images thus formed were checked.

For the above tests, there were provided two groups of developers, i.e., series 1 and series 2 each including a plurality of sets or combinations of an initial developer LT supplied to the upper space 13 and the lower space 14 of the developing apparatus 100, and a developer HT supplied to the cartridge. In addition, respective sets or combinations of series 1 and series 2 were applied to image forming apparatuses having different image output speeds. Here, note that the amount of electrification Q1 of the initial developer LT supplied to the upper space 13 and the lower space 14 of the developing apparatus 100 used in each image forming apparatus is constant in each developer series, i.e., 22 μc/g for series 1, and 37 μc/g for series 2. Also, in series 1, the toner was composed of polyester resin, and the carrier was composed of a core of ferrite coated with a silicon-based resin. In series 2, the toner was composed of styrene acrylic resin, and the carrier was composed of a core of ferrite coated with a fluorine-based resin.

One hundred thousand sheets of image formation were performed by using the plurality of replenishment developers HT having different amounts of electrification Q1 as mentioned above, and the results of checking the quality of the images thus formed are illustrated in FIG. 8. In FIG. 8, "○" represents that image formation was good, "x" represents that toner dispersion or reduction in image density occurred, and "Δ" represents that slight reduction in image density occurred. As can be seen from the results of FIG. 8, when the amount of electrification Q2 of the replenishment developer is too low, "fog" (smudge or soil in nonimage areas) occurred, and in particular, when equal to or lower than 10 μc/g, there occurred toner dispersion from the developing apparatus, too.

Accordingly, it is considered that although the amount of electrification of the developer LT existing in the upper space 13 and the lower space 14 of the developing apparatus 100 lowers in accordance with the printing of a multitude of sheets, reduction in the amount of electrification further proceeds due to the use of the replenishment developer that was prepared by adding a toner to a developer of a low amount of electrification. That is, it can be understood that a great difference in the quality of images formed will be generated in accordance with the progress of a multitude of prints due to the amount of electrification of the developer which is used to prepare the replenishment developer with the addition of the toner thereto. Further, it is found that a good result will be obtained in the case of a multitude of sheets of image formation when the ratio of the amount of electrification Q1 and the amount of electrification Q2 is within a prescribed range as defined by the following expression (1):

$$Q2=A\times Q1 \quad (1)$$

where A=0.6–1.5.

Figure 9:
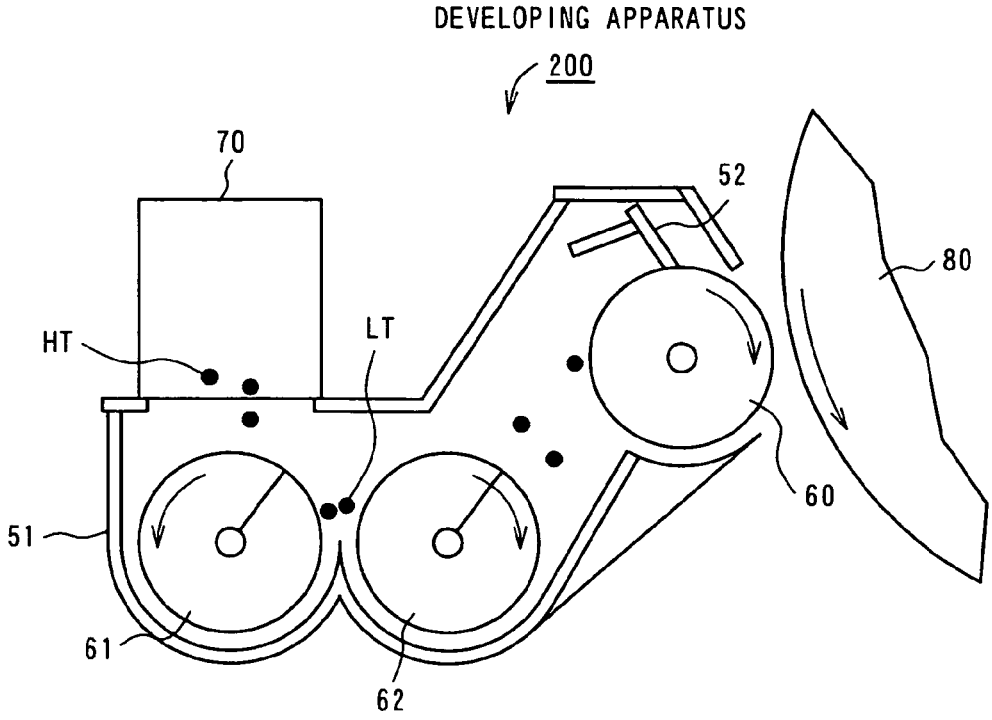
FIG. 9 is a cross sectional view showing another type of developing apparatus to which the embodiment of the present invention can be applied.

Here, note that although in the embodiment as illustrated in FIG. 1 through FIG. 8, a description has been made with the assumption that the developer LT is caused to circulate between the upper space 13 and the lower space 14, the same is true for the case where the developer LT is caused to circulate horizontally, as shown in FIG. 9. In the case of a developing apparatus 200 illustrated in FIG. 9, a developer LH is caused to circulate between a first and a second agitation and conveyance screw 61, 62 that are arranged horizontally in parallel with each other in an outer casing 51. A replenishment developer HT stored in a cartridge 70 is caused to drop onto the first agitation and conveyance screw 61 in appropriate timing so that the component composition of the developer LT is kept within a prescribed range. Also, the developer LT, being agitated and conveyed by the second agitation and conveyance screw 62, forms a magnetic brush whose height is limited by a doctor blade 52 on a developing roller 60. This magnetic brush is placed into contact with a photosensitive member 80 to supply the toner thereto, whereby it is put into use to develop an electrostatic latent image on the photosensitive member 80.

As described above in detail, according to the present invention, when the second two-component developer is replenished to the first two-component developer, the carrier of the second two-component developer has already been electrified to a sufficient extent, so that the second two-component developer can immediately exert a function similar to that of the first two-component developer. Accordingly, even if a multitude of sheets of image formation are carried out by the use of the first two-component developer which is being replenished with the second two-component developer, reduction in the amount of electrification of the first two-component developer can be decreased. As a result, the multitude of sheets of image formation can be continued while keeping the image quality in a good condition. On the other hand, the amount of the carrier in the second two-component developer is not particularly increased, so the consumption of the carrier does not increase.

What is claimed is:

1. A developing apparatus comprising:

a first storage part that stores a first two-component developer which has a first toner concentration of a toner and an amount of electrification Q1;

a second storage part that stores a second two-component developer which has a second toner concentration of said toner higher than that of said first two-component developer, and an amount of electrification Q2 when readjusted into the same toner concentration as that of said first two-component developer, where Q2=Q1×A (A=0.6–1.5);

a development processing part that supplies said first two-component developer to a developing roller so as to develop an electrostatic latent image on a photosensitive member; and a development control part that controls a component composition of said first two-component developer so as to keep the component composition within a prescribed range by replenishing said second two-component developer into said first two-component developer in an appropriate manner in accordance with the progress of the development process of said development processing part, wherein the second two-component developer is prepared by supplying agitation and charge to a two-component developer having a toner concentration of said toner less than or equal to that of the first two-component developer and thereafter adding said toner thereto.

2. A developing apparatus comprising:

a first outer casing that stores a first two-component developer which has a first toner concentration of a toner and an amount of electrification Q1;

a cartridge that stores a second two-component developer which has a second toner concentration of said toner higher than that of said first two-component developer, and an amount of electrification Q2 when readjusted to the same toner concentration as that of said first two-component developer, where Q2=Q1×A (A=0.6–1.5), said cartridge being detachably attached to said outer casing;

a development agitation and conveyance device that supplies said first two-component developer to a developing roller so as to develop an electrostatic latent image on a photosensitive member; and a development control part that controls a component composition of said first two-component developer so as to keep the component composition within a prescribed range by replenishing said second two-component developer into said first two-component developer in an appropriate manner in accordance with the progress of the development process of said development agitation and conveyance device, wherein the second two-component developer is prepared by supplying agitation and charge to a two-component developer having a toner concentration of said toner less than or equal to that of the first two-component developer and thereafter adding said toner thereto.

3. The developing apparatus as set forth in claim 1, wherein said first two-component developer has a toner concentration in a range of 4% -20%, and said second two-component developer has a toner concentration in a range of 75% -95%.

4. The developing apparatus as set forth in claim 2, wherein a degraded developer discharge port for overflowing said developer is provided in a side wall of a lower space defined by said outer casing.

5. The developing apparatus as set forth in claim 2, wherein said second two-component developer received in said cartridge is replenished into said outer casing in which said first two-component developer is stored in an appropriate manner so that said first toner concentration detected by a toner concentration sensor which detects a toner concentration becomes a prescribed range.

6. The developing apparatus as set forth in claim 1, wherein said second two-component developer is prepared by adding a toner to said first two-component developer.

7. The developing apparatus as set forth in claim 1, wherein the amount of electrification of said first two-component developer is greater than 10 μc/g.

8. A developing method comprising:

a step of storing a first two-component developer which has a first toner concentration of a toner and an amount of electrification Q1, and a second two-component developer which has a second toner concentration of said toner higher than that of said first two-component developer, and an amount of electrification Q2 when readjusted to the same toner concentration as that of said first two-component developer, where Q2=Q1×A (A=0.6–1.5);

a step of supplying said first two-component developer to a developing roller so as to perform development processing of an electrostatic latent image on a photosensitive member; and a step of controlling a component composition of said first two-component developer so as to keep the component composition within a prescribed range by replenishing said second two-component developer into said first two-component developer in an appropriate manner in accordance with the progress of said development process, wherein the second two-component developer is prepared by supplying agitation and charge to a two-component developer having a toner concentration of said toner less than or equal to that of the first two-component developer and thereafter adding said toner thereto.

9. A developing agent for a developing apparatus in which a first two-component developer of a first toner concentration of a toner stored in a first toner storage part of said developing apparatus, and a second two-component developer having a second toner concentration of said toner higher than that of said first toner concentration and an amount of electrification Q2 stored in a cartridge detachably attached to said first toner storage part are used as developers, wherein the amounts of electrification Q1, Q2 of said first and second two-component developers are set to be Q2=Q1×A (A=0.6–1.5) when the toner concentrations of said first and second two-component developers are readjusted to the same state, wherein the second two-component developer is prepared by supplying agitation and charge to a two-component developer having a toner concentration of said toner less than or equal to that of the first two-component developer and thereafter adding said toner thereto.

* * * * *